United States Patent [19]

Fischer

[11] Patent Number: 4,753,166

[45] Date of Patent: Jun. 28, 1988

[54] PRINTING MACHINE INK SMOOTHER

[75] Inventor: Hermann Fischer, Augsburg, Fed. Rep. of Germany

[73] Assignee: M.A.N.-ROLAND Druckmaschinen AG, Offenbach am Main, Fed. Rep. of Germany

[21] Appl. No.: 31,699

[22] Filed: Mar. 27, 1987

[30] Foreign Application Priority Data

Apr. 24, 1986 [DE] Fed. Rep. of Germany ..... 3613877

[51] Int. Cl.[4] ..... B41F 31/00

[52] U.S. Cl. ..... 101/349; 101/329; 101/DIG. 14

[58] Field of Search ..... 101/329, 349, 350, 351, 101/352, 169, 157, DIG. 14, 348

[56] References Cited

U.S. PATENT DOCUMENTS

| | | | |
|---|---|---|---|
| 2,076,203 | 4/1937 | Mailander | 101/350 X |
| 2,318,504 | 5/1943 | Lodding | 101/169 X |
| 4,126,091 | 11/1978 | Cohen | 101/169 X |
| 4,151,797 | 5/1979 | Dunsirn | 101/169 |
| 4,170,176 | 10/1979 | Domeniconi | 101/349 X |
| 4,354,449 | 10/1982 | Zink | 101/349 X |
| 4,398,463 | 8/1983 | Yessler, II | 101/169 |
| 4,458,592 | 7/1984 | Junghans | 101/349 |
| 4,577,557 | 3/1986 | Fischer | 101/217 |

FOREIGN PATENT DOCUMENTS

| | | |
|---|---|---|
| 238850 | 9/1910 | Fed. Rep. of Germany . |
| 346247 | 4/1920 | Fed. Rep. of Germany . |
| 2052806 | 5/1972 | Fed. Rep. of Germany . |
| 2902230 | 7/1980 | Fed. Rep. of Germany . |
| 3324893 | 3/1985 | Fed. Rep. of Germany . |
| 0154530 | 3/1982 | German Democratic Rep. . |

*Primary Examiner*—David Wiecking

*Attorney, Agent, or Firm*—Frishauf, Holtz, Goodman & Woodward

[57] ABSTRACT

For smoothing an ink film on an ink application roller, so that the ink film on the application roller which is also applied to the plate cylinder will be free from valleys, ridges, striations and the like, a plate-like stamp element (11) is engaged against the circumference of an ink application roller (9), preferably the last one in the direction of rotation of the plate cylinder (10). Preferably, the plate-like stamp element oscillates or reciprocates axially, and is engaged on the surface of the ink application roller (19) by an adjustable spring force (17, 18).

11 Claims, 1 Drawing Sheet

PRINTING MACHINE INK SMOOTHER

Reference to related patent disclosure: German Patent Disclosure Document No. DE-OS 20 52 806, Kantelberg.

The present invention relates to printing machines, and more particularly to rotary planographic printing machines having an inker which includes an ink trough, ductor or lifter and transfer and milling rollers, and at least one ink application roller; and, especially, to an apparatus to homogenize, or render uniform the ink film on the ink application roller.

BACKGROUND

German Patent Disclosure Document No. DE-OS 20 52 806 describes a printing machine inker in which a plurality of milling rollers, cooperating with an ink application roller, has doctor blades associated therewith. Ink which is stripped from the respective milling rollers is returned to an ink retention vessel. In operation, ink is applied to the respective rollers of the ink train such that more ink is supplied than necessary to ink the plate for printing. Initially, the ink application roller receives an ink layer which is substantially thicker than necessary. This ink layer is then split by the subsequent milling rollers and the ink which is removed from the application roller is stripped off the milling rollers and returned to the ink supply.

It has been found that the actually required ink for the application roller and/or the plate cannot be accurately determined by such a system. Applying a doctor blades to the rollers and/or controlling the operating time and strokes of a ductor roller from an ink trough cannot accurately control the uniformity, or smoothness of the ink supply. Rather, it is necessary to provide multiple splitting of the ink film between the application roller and the respective milling rollers in engagement therewith. However, any uneven ink distribution or ink strips or spots forming peaks and valleys of the ink firlm cannot be completely removed since the ink on the application roller is split at each milling roller into two partial films of equal thickness so that, in general principle, any uneven ink distribution will remain, although to a somewhat decreased absolute extent, while the percentage of change in thickness between the remaining film will continue to be present.

THE INVENTION

It is an object to provide an inker for a planographic rotary printing machine in which ink being applied to the plate cylinder can be accurately determined, and in which any peaks or valleys or non-uniform ink distribution zones are eliminated, so that the resulting ink film on the application roller will be uniform throughout its surface.

Briefly, the ink film on the application roller is rendered smooth by applying thereagainst a plate-like stamp or pressure element which has an essentially flat surface, positioned essentially tangentially with respect to the roller. This plate or stamp element is engaged with the surface of the ink application roller and extends over essentially the entire axial length of the ink application roller.

Some printing machines use more than one ink application roller and, for such installations, each one of the ink application rollers may have the smoothing stamp or plate element applied thereon. In accordance with a feature of the invention, the plate or stamp element may be reciprocated axially, similarly to recirpocation of an axially oscillating milling roller.

DRAWINGS

DETAILED DESCRIPTION

Figure 1:
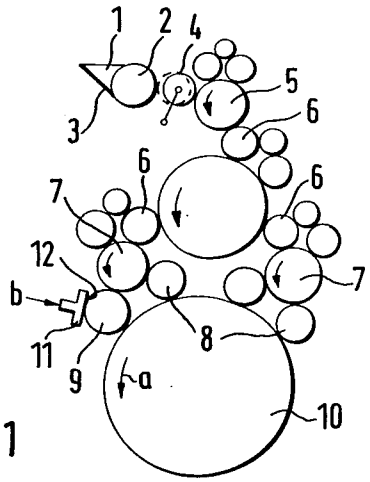
FIG. 1 is a schematic side view of a printing system including a plate cylinder, and an inker associated therewith.

The inker of FIG. 1, shown highly schematically, has an ink trough 1 in which an inker roller 2 is rotatably retained. Ink is stripped off the roller 2 by a doctor blade 3. A ductor or lifter roller 4 oscillates back and forth in engagement, selectively, with the trough roller 2 and a roller 5 forming part of an ink train. Roller 5 is, preferably, a milling roller, and has other rollers in engagement therewith. Ink is transferred via a group of set of transfer rollers 6 and a milling roller 7 to one or more ink application rollers 8, in engagement with the circumference of a plate on a plate cylinder 10. The specific arrangement of the rollers in the ink train of the inker or of the inker itself is of no significance with respect to the present invention; or for example of the ink supply system.

Besides ink application rolles 8, one of the transfer rollers 7 is in engagement with a further ink application roller 9. Ink application roller 9 is the last one—in the direction of rotation, see arrow a, of the plate cylinder 10—of the ink application rollers in the ink train. In accordance with a feature of the invention, the application roller 9 has a stamp or ink smoothing element 11 positioned tangentially on the surface of the application roller 9. The element 11 has a generally T-shaped cross section, and is formed with a surface 12 in engagement with the surface of the roller 9—see FIG. 2. The smoothing element 11 is pressed against the surface of roller 9 by a force schematically indicated by arrow b in FIG. 1. The cylinder 10 and roller 2-9, of course, have circular-cylindrical surfaces.

Figure 3:
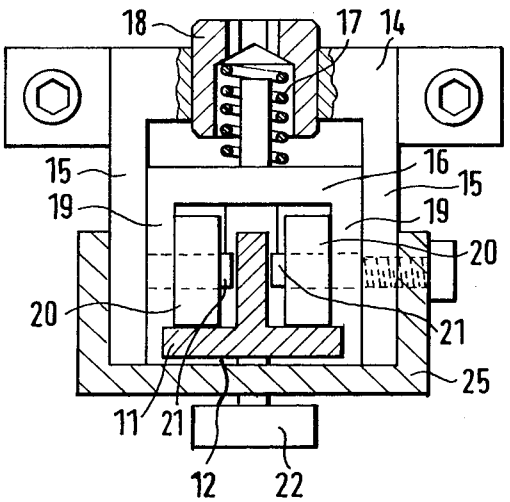
FIG. 3 is a cross-sectional view along line III—III of FIG. 2.
Figure 2:
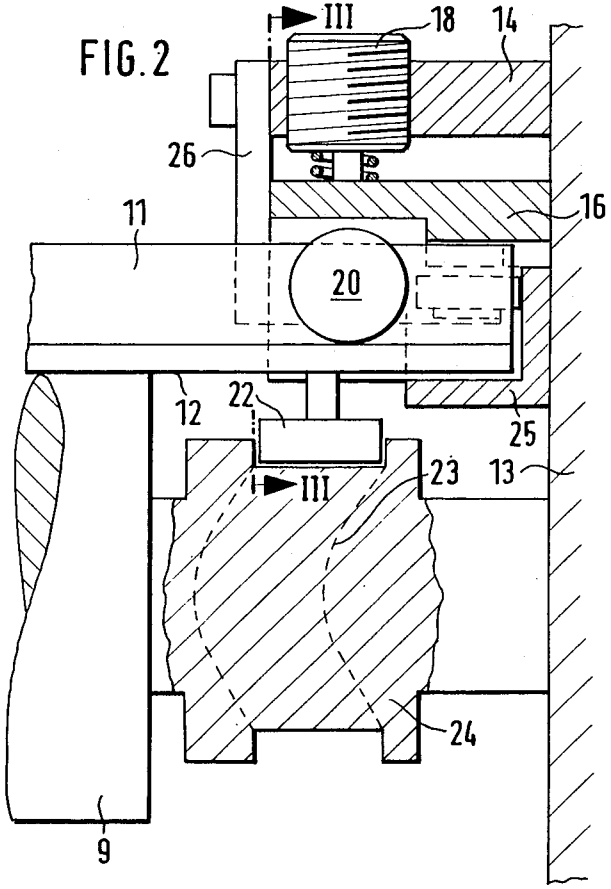
FIG. 2 is a fragmentary vertical part-sectional view showing the attachment and bearing arrangement for the smoothing plate or stamp.

The element 11 is held at the two axial ends in the side walls 13—see FIG. 2. FIG. 2 only shows one side end connection, the other side of which can be mirror-symmetrical with respect thereto. The side wall 13 has a support carrier 14 secured thereto, for example by welding. A holder element 16, which is movable, is positioned radially with respect to the application roller 9 between the two side elements 15 of the holder 14. A compression spring 17 is engaged on the holder 16, the other end of which is retained in a counter bearing 18 which is formed as a threaded set bolt, screwed in the carrier 14. By turning the counter bearing 18, the compression of the spring against the holder 16 can be adjusted. Spring 17 provides the force b (FIG. 1). The holder 16 is formed with two side portions 19, each of which supports a roller 20. The rollers 20, thus, are pressed by the action of the spring 17 to the smoothing element 11 and press the smoothing element 11 against the surface of the application roller 9.. The holder 16 further supports two rollers 21, shown only in fragmentary representation in FIG. 3, which engage from both sides against the T-shaped element 11 at the center leg of the T, and thus prevent lateral shift of the T portion of the element 11. A further roller 22 is secured to the bottom side of the smoothing element 11 to provide for axial—with respect to roller 9—oscillation of the smoothing plate element 11. Roller 22 is guided in a curved groove 23 of a flange 24, rotating with and secured to the application roller 9 or the rotating shaft thereof. Holder 14 additionally has a bottom part 25 which prevents the element 11 from falling out of the holder 15; a front plate 26 insures that the holder 16 cannot move except in a direction perpendicular to the axis of the application roller 9.

OPERATION

During operation of the printing machine, the ink film on the application roller 9 may become uneven, for example showing streaks, valleys, grooves, peaks or ridges; the thus non-uniform ink film on the application roller 9 will be smoothed by the plate portion of the stamp or compression element 11, under pressure of the force b exerted by the spring 17. This pressure can be adjusted. The element 11 will reciprocate axially, by guidance of the cam follower roller 22 in the cam groove 23, and thus any uneveness of the ink film on the application roller 9 wil be smooth and will be rendered uniform. The pressure of the stamp element 11 against the roller 9 should be so adjusted that the element 11 will not squeeze off ink from the application roller 9. The plate cylinder 10, thus, will have ink of uniform thickness applied thereto.

In the example selected, the application roller 9 applied most of the ink to the plate cyliner 10. It is, thus, usually sufficient to equip only the last one of the application rollers with the smoothing apparatus formed by the element 11. Basically, however, a smoothing element like the element 11 can be applied also to other ink application rollers for example any one or more of the rollers 8 as well.

Upon rotation of roller 9, the cam - cam follower arrangement formed by the cam groove 23 and the roller 22 cause axial reciprocation of the element 11. It is not absolutely necessary to provide for axial reciprocation or oscillations; in many cases, the pressure of the stamp element 11 against the application roller 9 provides for sufficient smoothing of the ink layer on the roller 9.

The stamp element 11 does not accept ink from the application roller 9, and thus the reciprocating time of the lifter roller 4 (FIG. 1) or, in film inkers, of the doctor blade 3, can be used to provide for simple and precise adjustment of the ink to be supplied to the plate cylinder.

Various changes and modifications may be made within the scope of the inventive concept.

I claim:

1. In combination with a planographic pringing machine, an inker to supply ink to a plate cylinder adapted to support a planographic printing plate having an ink supply roller means (1-5) and a plurality of ink distribution rollers (6, 7) forming an ink distribution train;

at least one ink application roller (8, 9) having a circular cylindrical surface in surface engagement with the plate on the plate cylinder, receiving ink from the ink train, and, in operation, accumulating an ink film on the roller, and comprising, in accordance with the invention, means for smoothing the ink film on the at least one ink application roller (8, 9), including a plate-like stamp element (11) having an essentially flat surface (12) extending over essentially the entire axial length of the at least one ink application roller; and means for positioning the plate-like stamp element (11) to engage the flat surface (12) thereof essentially tangentially with the surface of the at least one ink application roller (8, 9) for smoothing the ink film on the at least one ink application roller without squeezing off or splitting ink therefrom.

2. The inker of claim 1, wherein said at least one ink application roller comprises a plurality of ink application rollers (8, 9);

and wherein the plate-like stamp element (11) is in engagement with the last one (9) of said application rollers, with respect to the direction of rotation of the plate cylinder.

3. The inker of claim 1, including bias force means (b; 17) applying a force against the plate-like stamp element (11) to press the plate-like stamp element against the surface of the at least one application roller (8, 9).

4. The inker of claim 3, wherein the bias force means comprises a spring.

5. The inker of claim 3, wherein said at least one ink application roller comprises a plurality of ink application rollers (8, 9);

and wherein the plate-like stamp element (11) is in engagement with the last one (9) of said application rollers, with respect to the direction of rotation of the plate cylinder.

6. The inker of claim 1, further including means (22, 23) axially reciprocating the plate-like stamp element (11) on the surface of the at least one ink application roller.

7. The inker of claim 6, wherein said at least one ink application roller comprises a plurality of ink application rollers (8, 9);

and wherein the plate-like stamp element (11) is in engagement with the last one (9) of said application rollers, with respect to the direction of rotation of the plate cylinder.

8. The inker of claim 1, further including side walls (13) forming a frame for the printing machine;

holder means (14) retaining the plate-like stamp element (11) movably radially with respect to the at least one ink application roller (8, 9), secured to the side walls, said holder means forming said positioning means;

and spring means (17) positioned between the plate-like stamp element and the holder means and, adjustably, pressing the plate-like stamp element (11) against the at least one ink application roller.

9. The inker of claim 8, further including a counter bearing (18) adjustably supporting the spring means (17) on the holder means (14).

10. The inker of claim 8, further including a guide holder (16) positioned, respectively, at each axial end of the stamp element (11) and movably supporting the stamp element on the holder means (14).

11. The inker of claim 1, further including a cam track (23) rotating together with the at least one ink application roller and coupled thereto;

and a cam follower (22), connected to the plate-like stamp element (11) and engaged in said cam track, said cam track being shaped to cause axial reciprocating osciallatory movement of the plate-like stamp element with respect to the surface of the at least one ink application roller upon rotation of said at least one ink application roller.

* * * * *